US006786811B2

(12) United States Patent
Krondorfer et al.

(10) Patent No.: US 6,786,811 B2
(45) Date of Patent: Sep. 7, 2004

(54) GRINDING MACHINE TOOL SUPPORT

(75) Inventors: Harald Krondorfer, Ludwigsburg (DE); Ralph Dammertz, Stuttgart (DE); Zaal-Azhar Alias, Stuttgart (DE); Markus Heckmann, Filderstadt (DE); Joachim Schadow, Dettenhausen (DE); Thomas Schomisch, Leinfelden-Echterdingen (DE); Marco Brancato, Oberdorf (CH); Christof Hoelzl, Schwaz (AT); Johann Huber, Kramsach (AT); Wilhelm Schulze, Vomp (AT)

(73) Assignees: Robert Bosch GmbH, Stuttgart (DE); Tyrolit Schleifmittel Swarovski K.G., Schwaz (DE)

( * ) Notice: Subject to any disclaimer, the term of this patent is extended or adjusted under 35 U.S.C. 154(b) by 18 days.

(21) Appl. No.: 09/980,933

(22) PCT Filed: Mar. 28, 2001

(86) PCT No.: PCT/DE01/01178

§ 371 (c)(1),
(2), (4) Date: Feb. 20, 2002

(87) PCT Pub. No.: WO01/76822

PCT Pub. Date: Oct. 18, 2001

(65) Prior Publication Data

US 2003/0104773 A1 Jun. 5, 2003

(30) Foreign Application Priority Data

Apr. 7, 2000 (DE) ..... 100 17 458

(51) Int. Cl.[7] ..... B24B 41/00

(52) U.S. Cl. ..... 451/342; 451/508

(58) Field of Search ..... 451/342, 340, 451/359, 509, 508, 510, 341, 358, 352

(56) References Cited

U.S. PATENT DOCUMENTS

| | | | |
|---|---|---|---|
| 2,425,368 | A | 8/1947 | Doermann |
| 2,480,886 | A | 9/1949 | Stever |
| 2,747,343 | A | 5/1956 | Gellert |
| 2,781,618 | A | 2/1957 | Larson |
| 2,789,402 | A | 4/1957 | Tocci-Guilbert et al |
| 2,800,751 | A | 7/1957 | Brucker |
| 3,149,442 | A | 9/1964 | MacKay, Jr. |
| 3,157,010 | A | 11/1964 | Block |
| 3,158,972 | A | 12/1964 | MacKay, Jr., et al. |
| 3,266,200 | A | 8/1966 | Block |
| 3,270,467 | A | 9/1966 | Block |
| 3,270,468 | A | 9/1966 | Block |

(List continued on next page.)

FOREIGN PATENT DOCUMENTS

| | | |
|---|---|---|
| DE | 1 577 422 | 4/1970 |
| DE | 35 20 417 A1 | 12/1986 |
| DE | 196 50 364 A1 | 6/1998 |
| EP | 0 904 896 A2 | 3/1999 |
| FR | 2 235 586 | 1/1975 |
| WO | 88/04975 | 7/1988 |

*Primary Examiner*—Dung Van Nguyen
(74) *Attorney, Agent, or Firm*—Michael J. Striker

(57) ABSTRACT

A grinding machine tool receptacle for a hand-guided angle grinding machine has a slaving device by which an insert tool is operatively connectable to a drive shaft, the insert tool is operatively connectable to the slaving device via at least one detent element supported movably counter to a spring element, which detent element snaps into place in an operating position of the insert tool driven by the spring element and fixes the insert tool by positive engagement, the detent element is displaceable in the axial direction counter to the spring element, and the insert tool is connected to the slaving device in the circumferential direction via at least a first element and in the axial direction via at least a second element, with the second element arranged for fixing of the insert tool with a spring force.

19 Claims, 9 Drawing Sheets

U.S. PATENT DOCUMENTS

| | | | | | |
|---|---|---|---|---|---|
| 3,491,494 | A | | 1/1970 | MacKay, Jr. | |
| 3,623,281 | A | | 11/1971 | Moffat | |
| 3,667,169 | A | | 6/1972 | MacKay, Jr. | |
| 3,683,567 | A | | 8/1972 | Ali | |
| 4,245,438 | A | | 1/1981 | van Buren, Jr. | |
| 4,683,683 | A | | 8/1987 | Block | |
| 4,839,998 | A | | 6/1989 | Block | |
| 5,175,963 | A | | 1/1993 | Schafer et al. | |
| 5,388,942 | A | | 2/1995 | Bonacina et al. | |
| 5,619,770 | A | * | 4/1997 | Bell | 15/230.17 |
| 5,707,275 | A | * | 1/1998 | Preis et al. | 451/342 |
| 6,116,996 | A | * | 9/2000 | Yanase | 451/359 |

* cited by examiner

GRINDING MACHINE TOOL SUPPORT

BACKGROUND OF THE INVENTION

The invention is based on a grinding machine tool receptacle.

From European Patent Disclosure EP 0 904 896 A2, a grinding machine tool receptacle for a hand-held angle grinding machine is also known. The angle grinding machine has a drive shaft that has a thread on the side toward the tool.

The grinding machine tool receptacle also has a slaving means and a lock nut. For mounting a grinding wheel, the slaving means is slipped with a mounting opening onto a collar of the drive shaft and braced against a bearing face of the drive shaft by nonpositive engagement via the lock nut. The slaving means has a collar, extending axially on the side toward the tool, that on two radially opposed sides on its outer circumference has recesses that extend axially as far as a bottom of the collar. From each of the recesses, a respective groove extends on the outer circumference of the collar, counter to the driving direction of the drive shaft. The grooves are closed counter to the driving direction of the drive shaft and taper axially, beginning at the recesses, counter to the drive direction of the drive shaft.

The grinding wheel has a hub with a mounting opening, in which two opposed tongues are disposed, pointing radially inward. The tongues can be introduced axially into the recesses and then in the circumferential direction, counter to the driving direction, into the grooves. The grinding wheel is fixed by positive engagement in the grooves in the axial direction via the tongues and by nonpositive engagement by means of the tapering contour of the grooves. During operation, the nonpositive engagement increases as a consequence of reaction forces exerted on the grinding wheel, which act counter to the driving direction.

To prevent the grinding wheel from running off center when the drive shaft is braked by the slaving means, a stopper, which is movably supported in the axial direction in an opening, is disposed in the region of a recess on the circumference of the collar. In a working position where the grinding wheel points downward, the stopper is deflected axially by gravity in the direction of the grinding wheel and closes the groove in the direction of the recess and blocks a motion of the tongue, located in the groove, in the driving direction of the drive shaft.

SUMMARY OF THE INVENTION

The invention is based on a grinding machine tool receptacle, in particular for a hand-held angle grinding machine, having a slaving device, by way of which an insert tool can be operatively connected to a drive shaft.

It is proposed that the insert tool is operatively connectable to the slaving device via at least one detent element, supported movably counter to a spring element, which detent element snaps into place in an operating position of the insert tool and fixes the insert tool by positive engagement. By means of the positive engagement, high security can be attained, and a simple, economical, tool-less fast-clamping system can be created. Unintended running off center of the insert tool can be reliably avoided, even in braked drive shafts in which major braking moments can occur.

By means of the movably supported detent element, major deflection of the detent element in the assembly of the insert tool can be made possible, and as a result on the one hand a large overlap between two corresponding detent elements and an especially secure positive engagement can be attained, and on the other, a clearly audible snap-in noise can be achieved, which advantageously tells the user that the snap-in operation has been completed as desired.

The detent element can fix the insert tool by positive engagement either directly or indirectly via an additional component, for instance via a detent lever or tappet and the like that is coupled with the detent element and is supported rotatably and/or axially displaceably. The detent element can fix the insert tool by positive engagement directly and/or indirectly in various directions, such as the radial direction, axial direction, and/or especially advantageously the circumferential direction. It is also possible that as a result of the positive-engagement fixation of the insert tool with the detent element in a first direction, such as the radial direction, the insert tool is fixed by positive engagement in a second direction, such as the circumferential direction, by means of a component that is separate from the detent element.

The movably supported detent element can be embodied in various forms that appear useful to one skilled in the art, for instance as an opening, protrusion, peg, bolt and the like, and can be disposed on the insert tool and/or on the slaving device. The detent element itself can be supported movably in a component in a bearing location, for instance in a flange of the slaving device or in a tool hub of the insert tool. However, the detent element can advantageously also be solidly connected by nonpositive, positive and/or material engagement to a component supported movably in a bearing location, or can be embodied integrally with such a component, for instance with a component supported on the drive shaft or with a tool hub of the insert tool.

Also by means of the positive engagement, an advantageous encoding can be achieved, so that only the intended insert tools can be secured in the grinding machine the tool receptacle. The slaving device can be embodied at least in part as a detachable adapter part, or it can be connected nondetachably to the drive shaft by nonpositive, positive and/or material engagement.

With the grinding machine tool receptacle, various insert tools that appear useful to one skilled in the art can be secured, such as insert tools for severing, grinding, rough-machining, brushing and so forth. A tool receptacle of the invention can also be used to secure a grinding plate of eccentric grinding machines.

The detent element can be embodied movably in various directions counter to a spring element, for instance in the circumferential direction or especially advantageously in the axial direction, making a structurally simple embodiment attainable.

In a further feature of the invention, it is proposed that a drive moment can be transmitted via a positive-engagement connection between the insert tool and the slaving device. A major drive moment can be securely transmitted, and moreover, it is possible to prevent a drive moment from acting on a nonpositive connection.

If the detent element can be released from its detent position by an unlocking button and in particular is movable counter to the spring element, then an independent release of the detent connection which could for instance be caused by a braking moment can be reliably prevented, thus enhancing safety. Operation of the insert tool in two circumferential directions can be made possible in principle, making it more convenient to install and remove the insert tool.

It also proposed that the insert tool is connectable to the slaving device via a tongue-and-groove connection, which is secured by positive engagement via at least one detent element in an operating position of the insert tool. With a tongue-and-groove connection an especially space-saving, lightweight construction can be attained in which individual components are used for multiple functions, for instance the detent element and/or spring elements engaging grooves for radial centering, fixation in the axial direction, and/or fixation in the circumferential direction.

However, if the insert tool is connected to the slaving device in the circumferential direction via at least a first element and in the axial direction via at least a second element, then simple, economical tool hubs can be achieved which can advantageously be embodied in plane form. The tool hubs can be prevented from catching on each other in production and storage, and good manipulation of the insert tool with its tool hubs can be made possible. In addition, the components can advantageously be designed for their function, that is, either for the fixation in the circumferential direction or the fixation in the axial direction. The elements can be formed by one component or advantageously by separate components. The tool hubs can simply and advantageously be embodied with a closed centering bore, and low-vibration action of the insert tool can be made possible. In addition, given a suitable choice of the diameter of the centering bore, it is possible for the insert tools intended for the grinding machine tool receptacle of the invention to be secured to conventional grinding machines via fastening elements that have been known previously, specifically via fastening elements in which the insert tool can be fixed positively in the axial direction and nonpositively in the circumferential direction by an adjusting nut and a tensioning flange on the drive shaft against a bearing face.

In a further feature, it is proposed that at least one detent element, extending in the axial direction, snaps into a recess, corresponding to the detent element, of a tool hub of the insert tool in an operating position of the insert tool and fixes the insert tool in the circumferential direction by positive engagement. With a structurally simple embodiment, an advantageous positive engagement in one circumferential direction and preferably in both circumferential directions can be attained. The detent element extending in the axial direction can be formed by a separate bolt or a formed-on peg produced for instance by a deep-drawing operation.

Advantageously, at least one detent element extending in the axial direction is secured in a component supported displaceably on the drive shaft counter to the spring element. One and especially advantageously a plurality of detent elements via a large bearing area on the drive shaft. Tilting of the detent elements and relative motion of the detent elements can be reliably avoided, and with a spring element that can advantageously be disposed centrally and rotationally symmetrically, a desired spring force for a detent operation can be achieved. However, it is also possible for one or more detent elements, each at bearing points, to be embodied as displaceable counter to a respective spring element or counter to one common spring element.

It is also proposed that the slaving device has at least one fastening element, extending in the axial direction, which element can be passed through at least one region of an elongated slot of a tool hub of the insert tool and in the elongated slot is displaceable in a narrowed region of the elongated slot, and by way of which element the insert tool is axially fixable in the elongated slot via a contact face disposed on the fastening element. The tool hub can advantageously be embodied economically and essentially plane and can be used as a spring element, for instance by providing that the tool hub is elastically deformed upon displacement of the component in the elongated slot. The tool hub can also be used to deflect a component counter to a spring element in the axial direction. This economizes on additional components, assembly effort, and expenses.

To make a long spring travel of the tool hub possible, advantageously a component forming a bearing face for the insert tool, in the fastened state of the insert tool, has a recess in the region of the elongated slot, into which recess part of the tool hub is pressed elastically, in an operating position of the insert tool.

If the fastening element extending in the axial direction is supported elastically displaceably in the axial direction counter to a spring element, for axially the insert tool, then on the one hand an advantageously long spring travel can be attained independently of the tool hub, and on the other, the component and the spring element can be designed in a targeted way for their separate functions. However, the fastening element can also be embodied integrally with a spring element, at least in part. If for axial fixation a plurality of components extending in the axial direction are provided, then they can each be loaded via a respective spring element or advantageously all via one common spring element, making it possible to economize on additional components, assembly effort, weight, and expense.

To attain advantageous centering and low-vibration action of the insert tool, a collar by way of which the insert tool can be radially centered is preferably formed onto a component of the slaving device that forms a bearing face for the insert tool. A self-contained centering face can simply be formed. Forces on the insert tool in the radial direction can advantageously be absorbed by positive engagement, such as forces in the radial direction upon cutting of some object. Forces in the radial direction can be prevented from acting on components that are axially displaceable, thus preventing consequent damage or wear to these components. Furthermore, radial play of the insert tool is reliably avoided, making better concentricity attainable. In principle, instead of a collar, an indentation is also conceivable, which the tool hub engages with a protrusion in the fastened state.

If at least one detent element is formed integrally on a disklike component and/or if at least two elements for fixation of the insert tool in the axial direction are integrally formed onto a disklike component, then additional components and installation effort and expense can be saved. Furthermore, press-fitted connections between individual components with the attendant weak points can be avoided.

BRIEF DESCRIPTION OF THE DRAWING

Further advantages will become apparent from the ensuing description of the drawings. Exemplary embodiments of the invention are shown in the drawing. The drawing, description and claims include numerous characteristics in combination. One skilled in the art will expediently consider the characteristics individually as well and put them together to make useful further combinations.

Shown are.

DESCRIPTION OF THE PREFERRED EMBODIMENTS

Figure 1:
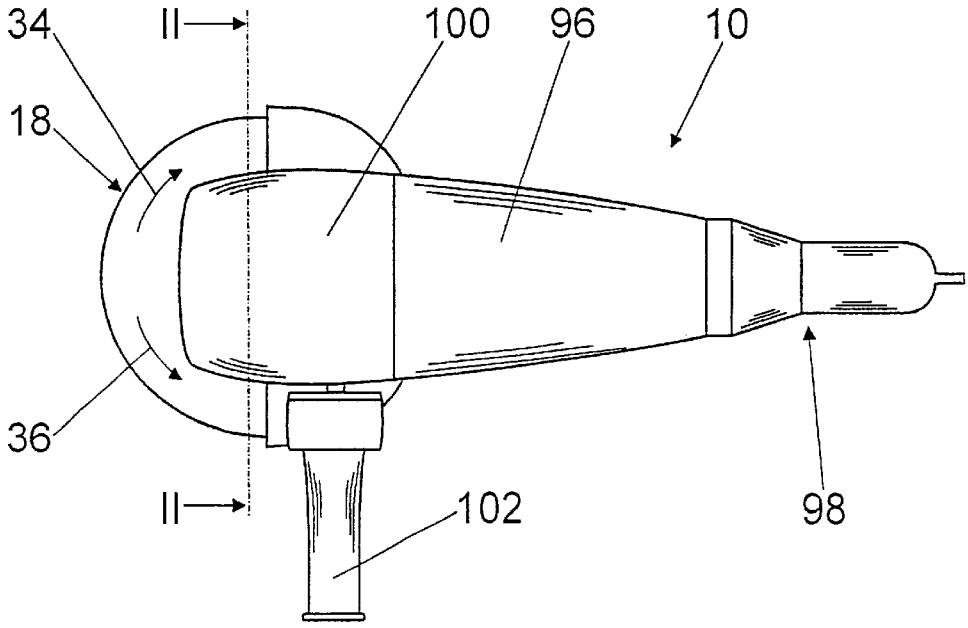
FIG. 1, an angle grinder from above.

FIG. 1 shows an angle grinding machine 10 from above, with an electric motor, not shown, supported in a housing 96. The angle grinding machine 10 can be guided via a first handle 98, which is integrated with the housing 96 on the side remote from a cutting disk 18 and extending longitudinally, and via a second handle 102, secured to a gearbox 100 in the region of the cutting disk 18 and extending transversely to the longitudinal direction.

Figure 2:
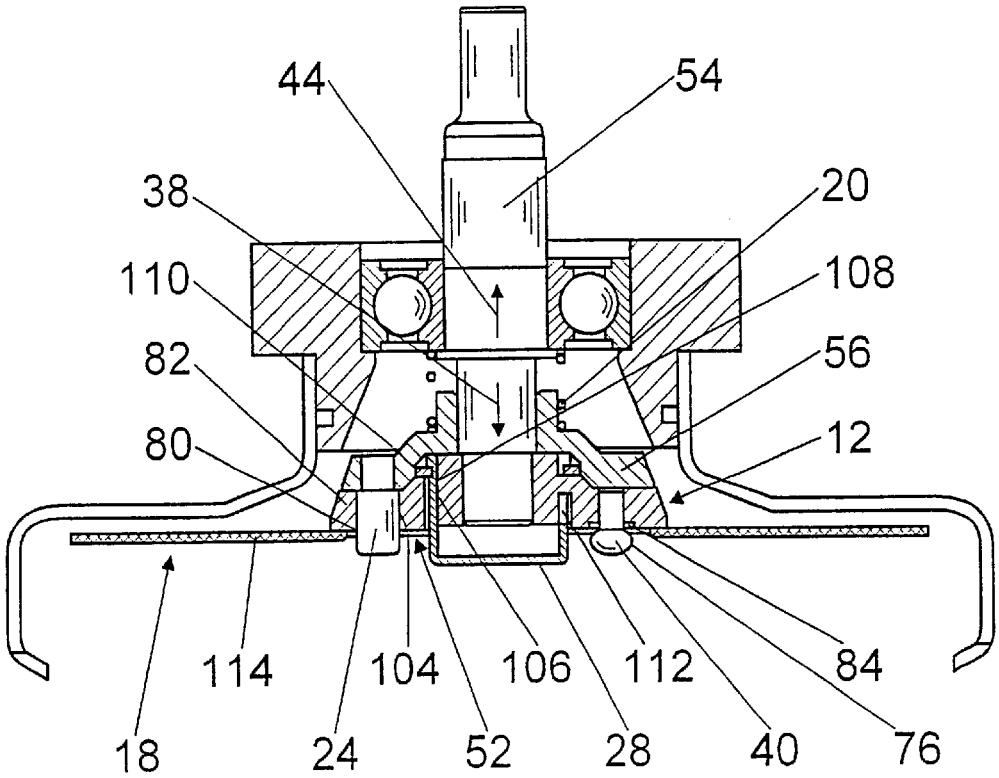
FIG. 2, a schematic cross section taken along the line II—II of FIG. 1 through a grinding machine tool receptacle of the invention.

With the electric motor, via a gear not shown, a drive shaft 54 can be driven, on whose end pointing toward the cutting disk 18 a slaving device 12 is disposed (FIG. 2). The slaving device 12, on a side toward the cutting disk 18, has a slaving flange 82 pressed firmly onto the drive shaft 54, and on a side remote from the cutting disk 18, it has a slaving disk 56 that is supported displaceably on the drive shaft 18 axially counter to a centrally disposed helical spring 20.

In the slaving flange 82, three pins 40 disposed at uniform intervals one after the other in the circumferential direction 34, 36 and extending in the axial direction 38 to the cutting disk 18 past the slaving flange 82 are press-fitted into the slaving flange 82. On their end pointing toward the cutting disk 18, the pins 40 each have one head, which has a larger diameter than a remainder of the pin 40, and on a side toward the slaving flange 82, this head has a transmission face 76 that narrows in the axial direction 44. The slaving flange 82 forms an axial bearing face 80 for the cutting disk 18, which face defines an axial position of the cutting disk 18; recesses 84 are made in this face in the region of the pins 40. Three axial through bores 104 are also made in the slaving flange 82 one after the other in the circumferential direction 34, 36; specifically, one through bore 104 is disposed between each two pins 40 in the circumferential direction 34, 36.

Three bolts 24 are press-fitted one after the other in the circumferential direction 34, 36 into the slaving disk 56 that is supported axially displaceably on the drive shaft 54; these bolts extend in the axial direction 38 to the cutting disk 18 via the slaving disk 56. The slaving disk 56 is pressed by the helical spring 20 in the direction 38 toward the cutting disk 18 against the slaving flange 82. The bolts 24 protrude through the through bores 104 and extend in the axial direction 38 past the slaving flange 82.

The slaving device 12 also has a cup-shaped unlocking button 28, disposed centrally on the side toward the cutting disk 18. The unlocking button 28 has three segments 106, distributed uniformly in the circumferential direction 34, 36 and extending in the axial direction 44 to the axially movably supported slaving disk 56, which segments reach through corresponding recesses 108 in the slaving flange 82 and are secured against falling out in the axial direction 38, 44 via a snap ring 110 with the slaving disk 56. The unlocking button 28 is guided displaceably in the axial direction 38, 44 in an annular recess 112 in the slaving flange 82.

Figure 3:
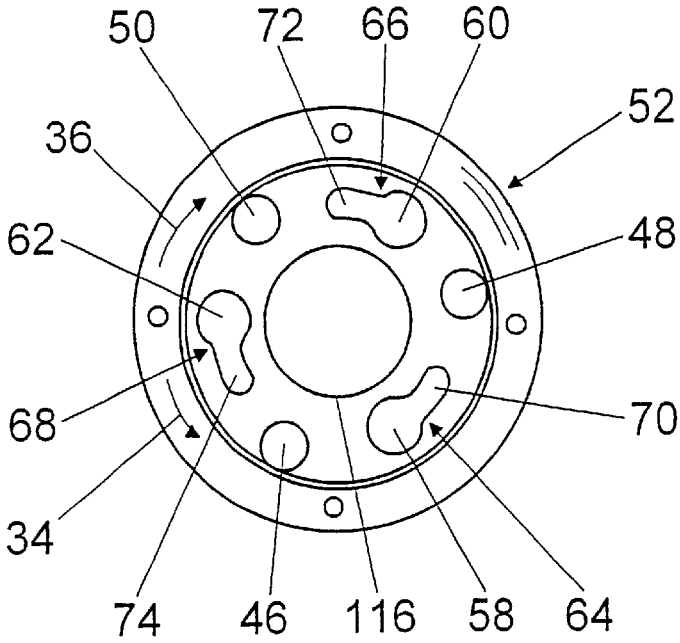
FIG. 3, a tool hub seen from below.

The cutting disk 18 has a sheet-metal hub 52, which is connected solidly to a grinding means 114 via a rivet connection, not shown in detail, and pressed (FIG. 3). The tool hub could also be made of some other material appearing useful to one skilled in the art, such as plastic, and so forth. The sheet-metal hub 52, in succession in the circumferential direction 34, 36, has three uniformly distributed bores 46, 48, 50, whose diameter is slightly greater than the diameter of the bolts 24. The sheet-metal hub 52 also has three elongated slots 64, 66, 68, extending in the circumferential direction 34, 36 and distributed uniformly in the circumferential direction 34, 36, each having a respective narrow region 70, 72, 74 and a respective wide region 58, 60, 62 that is produced by means of a bore, and whose diameter is slightly greater than the diameter of the heads of the pins 40.

The sheet-metal hub 52 has a centering bore 116, whose diameter is advantageously selected such that the cutting disk 18 can be clamped on a conventional angle grinding machine using a conventional chucking system with a chucking flange and a spindle nut. This assures so-called downward compatibility.

Upon installation of the cutting disk 18, the cutting disk 18 is slipped with its centering bore 116 onto the unlocking button 28 and centered radially. Next, the cutting disk 18 is rotated, until the pins 52 engage the wide regions 58, 60, 62, intended for them, in the elongated slots 64, 66, 68 of the sheet-metal hub 52. Pressing the sheet-metal hub 52 against the bearing face 80 of the slaving flange 82 has the effect that the bolts 24 in the through bores 104 and also the slaving disk 56 are displaced counter to a spring force of the helical spring 20 axially on the drive shaft 54 in the direction 44 remote from the cutting disk 18.

Further rotation of the sheet-metal hub 52 counter to the drive direction 34 has the effect that the pins 40 are displaced into the curved, narrow regions 70, 72, 74 of the elongated slots 64, 66, 68. In the process, with their conical contact faces 76, the pins 40 press against the edges of the elongated slots 64, 66, 68 and press them elastically into the recesses 84 of the slaving flange 82. As a result, the sheet-metal hub 52 is pressed against the bearing face 80 and is fixed in the axial direction 38, 44.

In a terminal position, or in an operating position of the cutting disk 18 that is attained, the bores 46, 48, 50 in the sheet-metal hub 52 come to rest above the through bores 104 of the slaving flange 82. By the spring force of the helical spring 20, the bolts 24 are axially displaced in the direction 38 of the cutting disk 18 and snap into the bores 46, 48, 50 of the sheet-metal hub 52 and fix the sheet-metal hub by positive engagement in both circumferential directions 34, 36. Upon snapping into place, a snapping noise that is audible to a user occurs, indicating operating readiness to the user.

A driving moment of the electric motor of the angle grinding machine 10 can be transmitted by the drive shaft 54 to the slaving flange 82 by nonpositive engagement and by the slaving flange 82 to the cutting disk 18 via the bolts 24 by positive engagement. The drive moment is transmitted solely via the bolts 24, since the elongated slots 64, 66, 68 are designed such that when the bolts 24 have snapped into place, the pins 40 do not come to rest on the end of the narrow regions 70, 72, 74 of the elongated slots 64, 66, 68. In addition, a braking moment that occurs when the electric motor is switched off and thereafter and which is oriented counter to the driving moment can be transmitted by positive engagement from the slaving flange 82 to the cutting disk 18 via the bolts 24. Unintended loosening of the cutting disk 18 is reliably avoided. By means of the three bolts 24 uniformly distributed in the circumferential direction 34, 36, an advantageous uniform distribution of both force and mass is attained.

To release the cutting disk 18 from the angle grinding machine 10, the unlocking button 28 is pressed. The slaving disk 56 is displaced with the bolts 24 via the unlocking button 28, counter to the helical spring 20, in the axial direction 44 remote from the cutting disk 18, and as a result the bolts 24 move in the axial direction 44 out of their detent position, that is, out of the bores 46, 48, 50 of the sheet-metal hub 52. Next, the cutting disk 18 is rotated in the driving direction 34, specifically until the pins 40 come to rest in the wide regions 58, 60, 62 of the elongated slots 64, 66, 68, and the cutting disk 18 can be removed from the slaving flange 82 in the axial direction 38. Once the unlocking button 28 is let go, the slaving disk 56, bolts 24 and unlocking button 28 are displaced backward into their outset positions by the helical spring 20.

Figure 4:
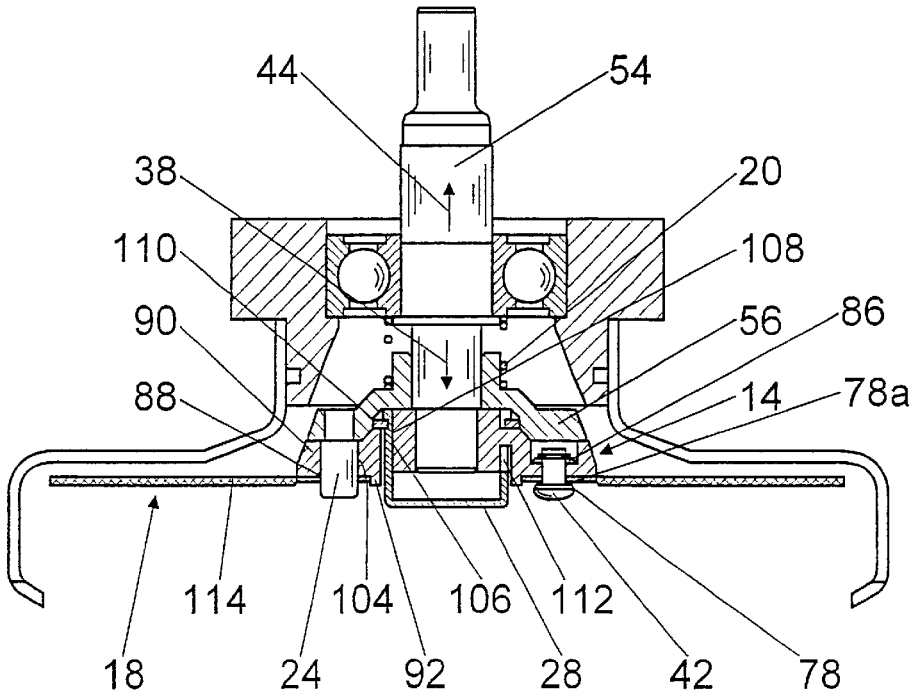
FIG. 4, a variant of FIG. 2.

In FIG. 4, an alternative exemplary embodiment to the exemplary embodiment of FIG. 2 is shown, with a slaving device 14. Components that remain essentially the same are identified by the same reference numerals in the exemplary embodiments shown. Also, the description of the exemplary embodiment in FIGS. 2 and 3 can be referred to for characteristics and functions that remain the same.

The slaving device 14 has a slaving flange 102 pressed onto the drive shaft 54. A collar 92 is formed onto the slaving flange 90, which forms a bearing face 88 for the cutting disk 18; by way of this collar, the cutting disk 18 is radially centered in the state in which it is mounted with its centering bore 116. Radial forces can advantageously be absorbed by the slaving flange 90 without putting a load on the unlocking button 28.

Also in the slaving flange 90, three pins 42 distributed uniformly in the circumferential direction 34, 36 and extending in the axial direction 38 past the bearing face 88 are supported displaceably in the axial direction 38, each against a respective cup spring 86, for the sake of axial fixation of the cutting disk 18. Each of the pins 42, on its end pointing toward the cutting disk 18, has a head, which has a larger diameter than a remaining portion of the pin 42, and on a side toward the slaving flange 90, the pins have a conical contact face 78, which tapers in the axial direction 44, and a contact face 78*a* extending parallel to the bearing face 78. If the heads of the pins 42 are guided bythe wide regions 58, 60, 62 of the elongated slots 64, 66, 68, then a rotation of the sheet-metal hub 52 counter to the driving direction 34 causes the pins 40 to be displaced into the curved narrow regions 70, 72, 74 of the elongated slots 64, 66, 68. In the process, the pins 42 are displaced axially in the direction 38, counter to the pressure of the cup springs 86, via the conical contact faces 78 until the contact faces 78*a* of the pins 42 cover the edges of the elongated slots 64, 66, 68 in the curved narrow regions 70, 72, 74.

In the installed state, the cup springs 86, via the contact faces 78*a* of the pins 428, press the cutting disk 18 against the bearing face 88. Instead of being loaded with a plurality of cup springs 86, the pins can also be loaded via other spring elements that appear useful to one skilled in the art, such as one cup spring, not shown, extending over the full circumference. The exemplary embodiment shown in FIG. 4, with the axially displaceably supported pins 42, is especially suitable for thick tool hubs or tool hubs that are not very deformable elastically.

Figure 8:
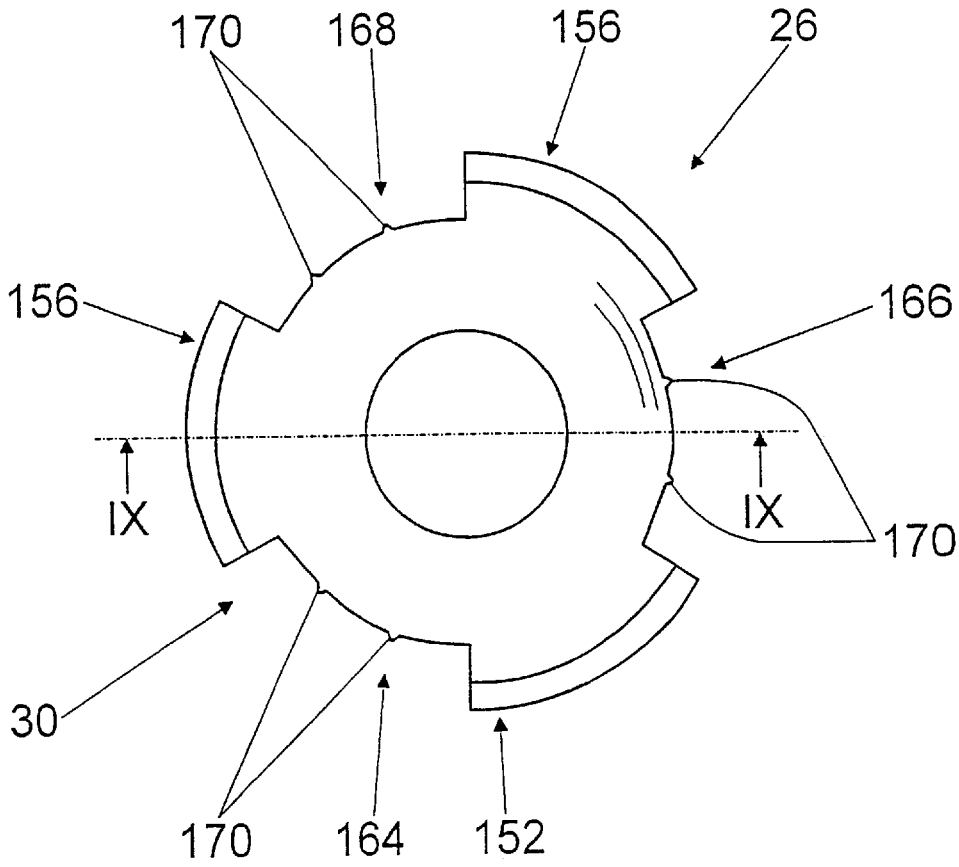
FIG. 8, an unlocking button of FIG. 5 from below.
Figure 9:
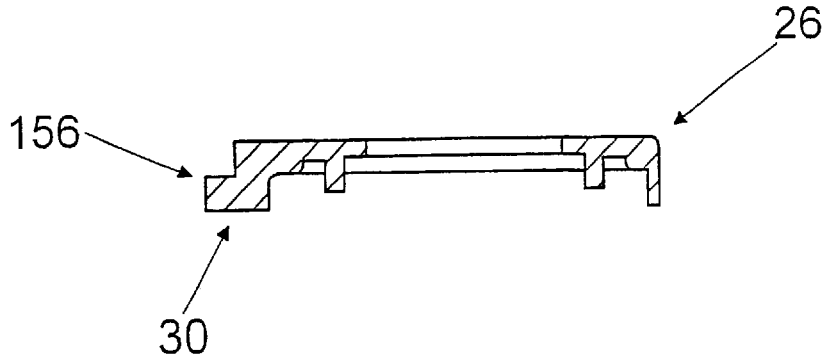
FIG. 9, a section taken along the line IX—IX of FIG. 8.
Figure 10:
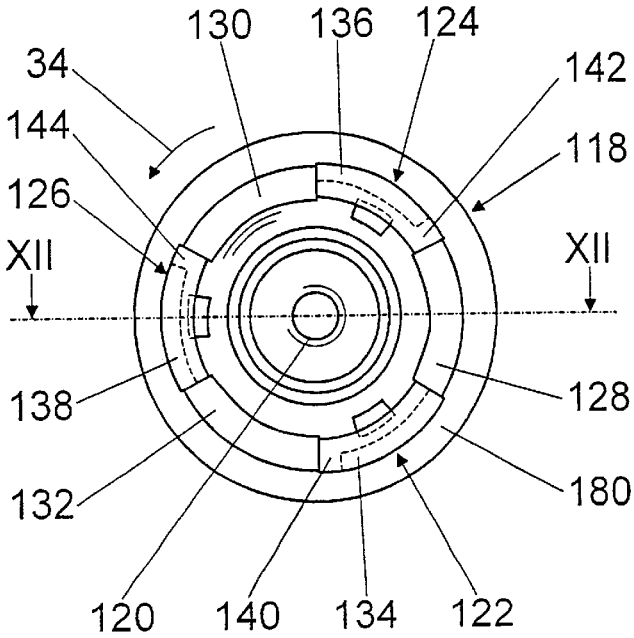
FIG. 10, a slaving element of FIG. 5 from below.
Figure 11:
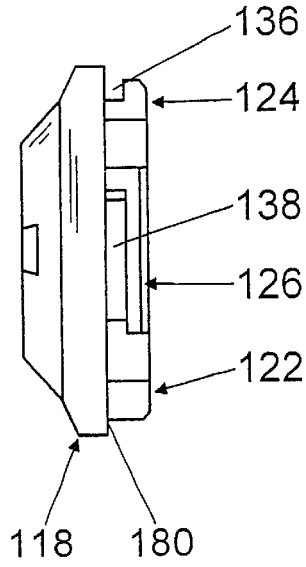
FIG. 11, the slaving element of FIG. 10 from the side.
Figure 12:
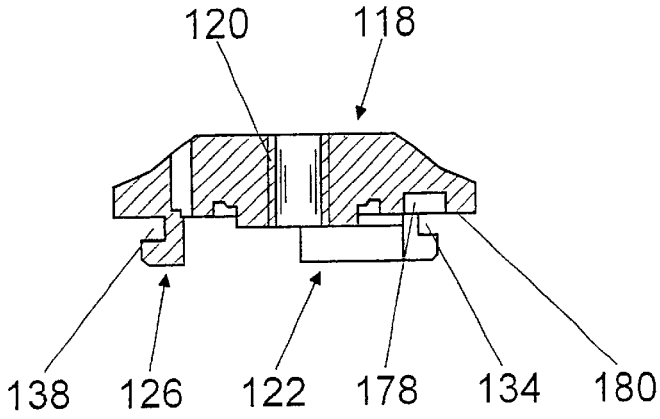
FIG. 12, a section taken along the line XII—XII of FIG. 10.

In FIGS. 5–12, one further exemplary embodiment with a slaving device 16 is shown. The slaving device 16 has a slaving flange 118 (FIG. 5; FIGS. 10, 11 and 12) secured via a thread 120 to a drive shaft not identified by reference numeral. The slaving flange could also be joined to the drive shaft via an inseparable connection or integrally embodied with it.

The slaving flange 118 has three segments 122, 124, 126, distributed uniformly in the circumferential direction 34, 36 and extending in the axial direction 38 toward a cutting disk 32, and between the segments it has interstices 128, 130, 132 (FIG. 10). Each of these segments 122, 124, 126 has a groove 134, 136, 138 on its circumference; these grooves are closed counter to the drive direction 34, each via a respective rotation stop 140, 142, 144, and are open in the drive direction 34. The slaving flange 118 furthermore has a bearing face 180, which defines an axial position of the cutting disk 32. The segments 122, 124, 126 furthermore form a centering collar for the cutting disk 32, by way of which the cutting disk 32 can be centered.

Figure 5:
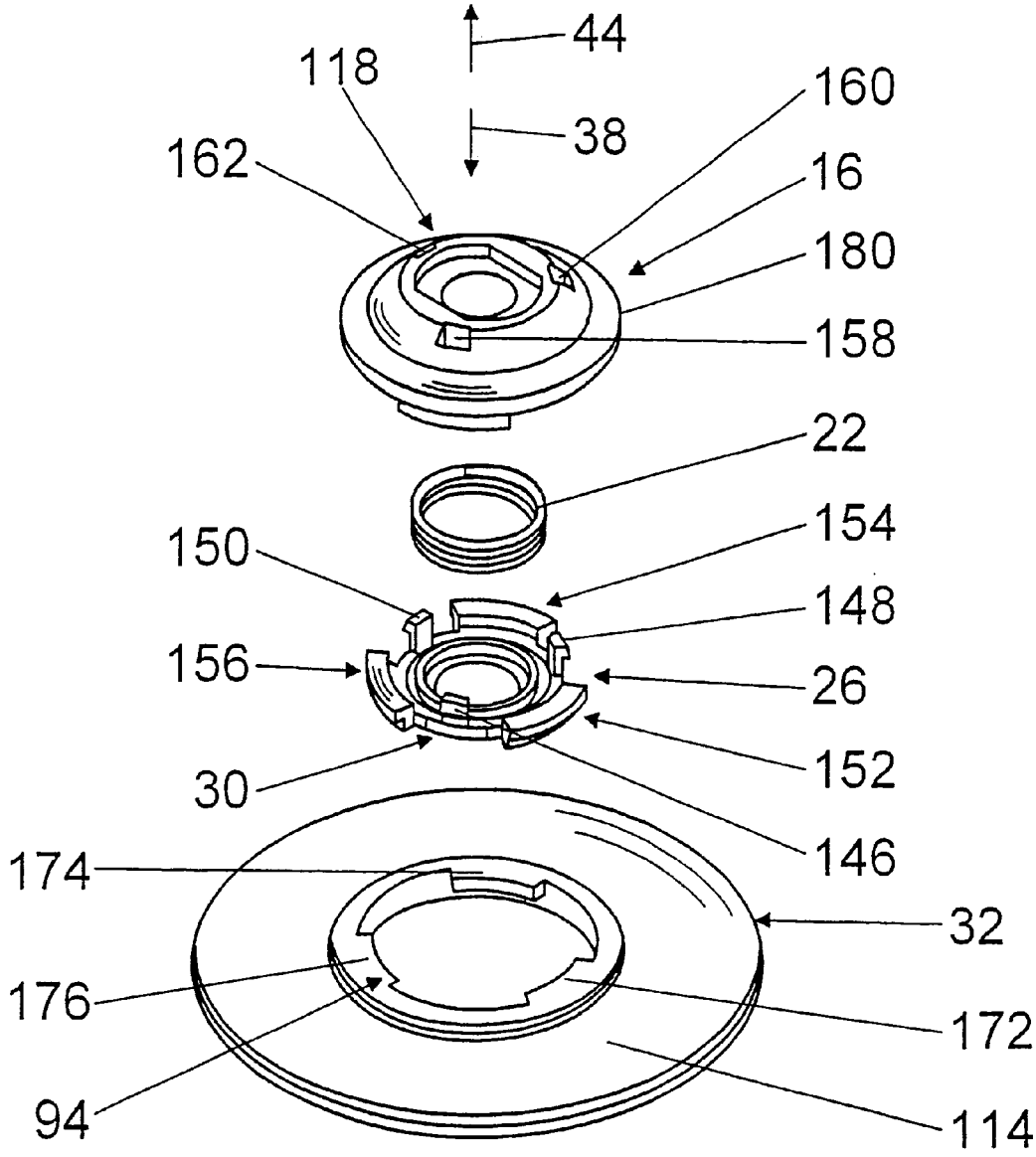
FIG. 5, an exploded view of a variant of FIG. 4.

In the installed state, a detent element 26 is connected to the slaving flange 118 via three detent pegs 146, 148, 150 distributed in the circumferential direction 34, 36, which reach through corresponding recesses 158, 160, 162 of the slaving flange 118 and radially outward engage the slaving flange 118 from behind (FIGS. 5, 8 and 9). On the detent element 26, which at the same time forms an unlocking button 30, three radially outward-extending blocking segments 152, 154, 156 are formed on, distributed uniformly in the circumferential direction 34, 36. Between the slaving flange 118 and the detent element 26 is a helical compression spring 22, against which the detent element 26 is displaceable, in the axial direction 44 remote from the cutting disk 32, relative to the slaving flange 118. Via radially outward-pointing bearing faces 164, 166, 168 between the blocking segments 152, 154, 156, the detent element 26 is guided in radially inward-pointing faces of the segments 122, 124, 126 of the slaving flange 118. To prevent canting of the detent element 26 and to attain small bearing faces 164, 166, 168, the bearing faces 164, 166, 168 are formed by radially outward-extending protrusions 170 (FIG. 8).

In the installed state, the blocking segments 152, 154, 156 are located in the interstices 128, 130, 132 of the slaving flange 118 and protrude radially past a groove bottom of the grooves 134, 136, 138. In an outset position, before the cutting disk 32 is installed, the blocking segments 152, 154, 156 of the detent element 26 are located in front of the grooves 134, 136, 138, and specifically are loaded by the prestressed helical compression spring 22.

Figure 6:
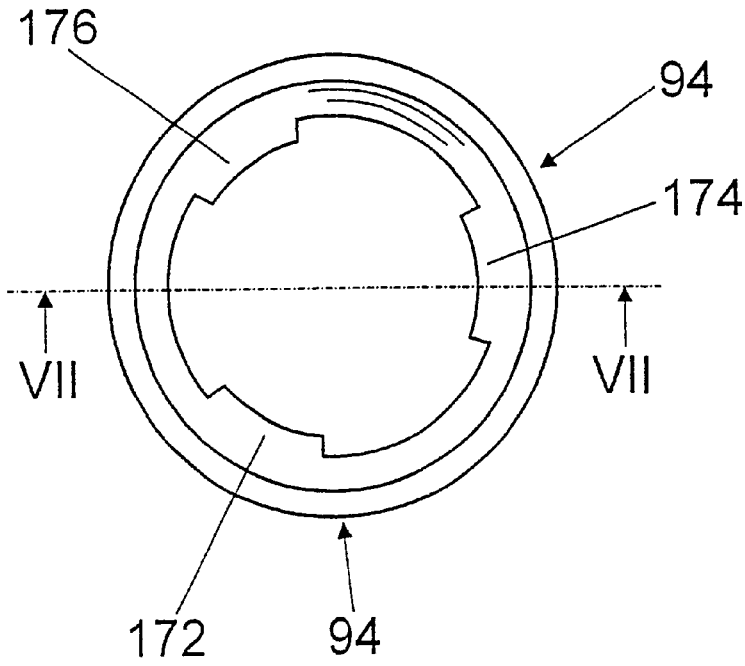
FIG. 6, a tool hub of FIG. 5 from below.
Figure 7:
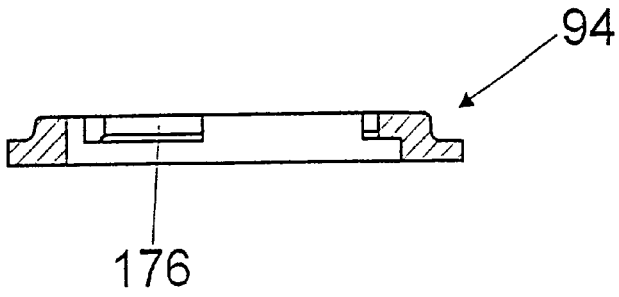
FIG. 7, a section taken along the line VII—VII of FIG. 6.

The cutting disk 32 has an annular sheet-metal hub 94, which is pressed on its outer diameter by a grinding means 114 and on its inner diameter has radially inward-pointing tongues or spring elements 172, 174, 176 (FIGS. 5, 6 and 7). In conjunction with the slaving flange 118 and the unlocking button 30, the spring elements 172, 174, 176 serve to transmit the drive moment, to position the cutting disk 32 axially, and to secure the cutting disk 32 against running off center when the electric motor is turned off or the drive shaft is braked. In addition, along with the segments 122, 124, 126, the spring elements can be used for centering the cutting disk 32 relative to the drive shaft.

In the installation of the cutting disk 32, the cutting disk is aligned with the slaving flange 118, so that the spring elements 172, 174, 176 on the inner diameter of the sheet-metal hub 94 point into the interstices 128, 130, 132 between the segments 122, 124, 126 of the slaving flange 118. The spring elements 172, 174, 176 of the cutting disk 32 rest on the blocking segments 152, 154, 156 of the unlocking button 30. Next, the cutting disk 32 is pressed in the axial direction 44 until it reaches the bearing face 180 of the slaving flange 118. The spring elements 172, 174, 176 of the cutting disk 32 rest on the blocking segments 152, 154, 156 of the unlocking button 30. Next, the cutting disk 32 is pressed in the axial direction 44 until it reaches the bearing face 180 of the slaving flange 118. The spring elements 172, 174, 176 displace the unlocking button 30, with its blocking segments 152, 154, 156, in the direction 44 axially remote from the cutting disk 32, counter to the spring force of the helical compression spring 22. The blocking segments 152, 154, 156 are pressed into recesses 178 of the slaving flange 118 (FIG. 12), so that the spring elements 172, 174, 176 come to rest in front of the grooves 134, 136, 138.

In the process, the cutting disk 32 is radially centered via the centering collar formed by the segments 122, 124, 126. By rotation of the cutting disk 32 counter to the drive direction 34, the spring elements 172, 174, 176 engage the grooves 134, 136, 138 of the slaving flange 118. A tongue-and-groove connection is made. The spring elements 172, 174, 176 have the same length, or a slightly shorter length, in the circumferential direction 36 than the grooves 134, 136, 138. Once the spring elements 172, 174, 176 have been thrust all the way into the grooves 134, 136, 138, that is, once an operating position of the cutting disk 32 is reached, the detent element 26 with its blocking segments 152, 154, 156 snaps into place, and the helical compression spring 22 presses the detent element 26 with its blocking segments 152, 154, 156 into its outset position, so that once again the blocking segments 152, 154, 156 come to rest in front of the grooves 134, 136, 138. With its blocking segments 152, 154, 156, the detent element 26 fixes the cutting disk 32 by positive engagement counter to the drive direction 34. The process of snapping into place creates a snap-in noise that is audible to a user and indicates to the user that the snap-in process has been completed as desired, and the system is ready for operation.

The transmission of the drive moment to the spring elements 172, 174, 176 of the sheet-metal hub 94 or cutting disk 32 is done by positive engagement via the rotation stops 140, 142, 144 of the slaving flange 118. The cutting disk 32 is centered via the centering collar formed by the segments 122, 124, 126 of the slaving flange 118 and is held in its axial position by the bearing face 180 and the grooves 134, 136, 138. In addition, a braking moment, oriented counter to the drive moment and occurring upon and after the shutoff of the electric motor, is transmitted by positive engagement from the blocking segments 152, 154, 156 and the slaving flange 118 to the spring elements 172, 174, 176 of the cutting disk 32.

An equalization of play is achieved in the axial direction by means of a spring element, not identified by reference numeral but formed by a sheet-metal strip, in the grooves 134, 136, 138. An equalization of play could also be attained via other spring elements appearing useful to one skilled in the art, such as spring-loaded balls that are placed at suitable points of the slaving flange and that fix the tool hub of the cutting disk without play, and/or with a slight oversize of the spring elements of the tool hub, by means of a slightly wedgelike shape of the grooves and the spring elements of the tool hub, and so forth.

For releasing the cutting disk 32, the unlocking button 30 is pressed in the axial direction 44 remote from the cutting disk 32. The blocking segments 152, 154, 156 of the unlocking button 30 and of the detent element 26 are displaced into the recesses 178 of the slaving flange 118. Next, with its spring elements 172, 174, 176, the cutting disk 32 can be rotated in the drive direction 34 out of the grooves 134, 136, 138 of the slaving flange 118 and pulled off in the axial direction 38. As the cutting disk 32 is pulled off, the unlocking button 30 is compressed into its outset position by the helical compression spring 22.

Figure 13:
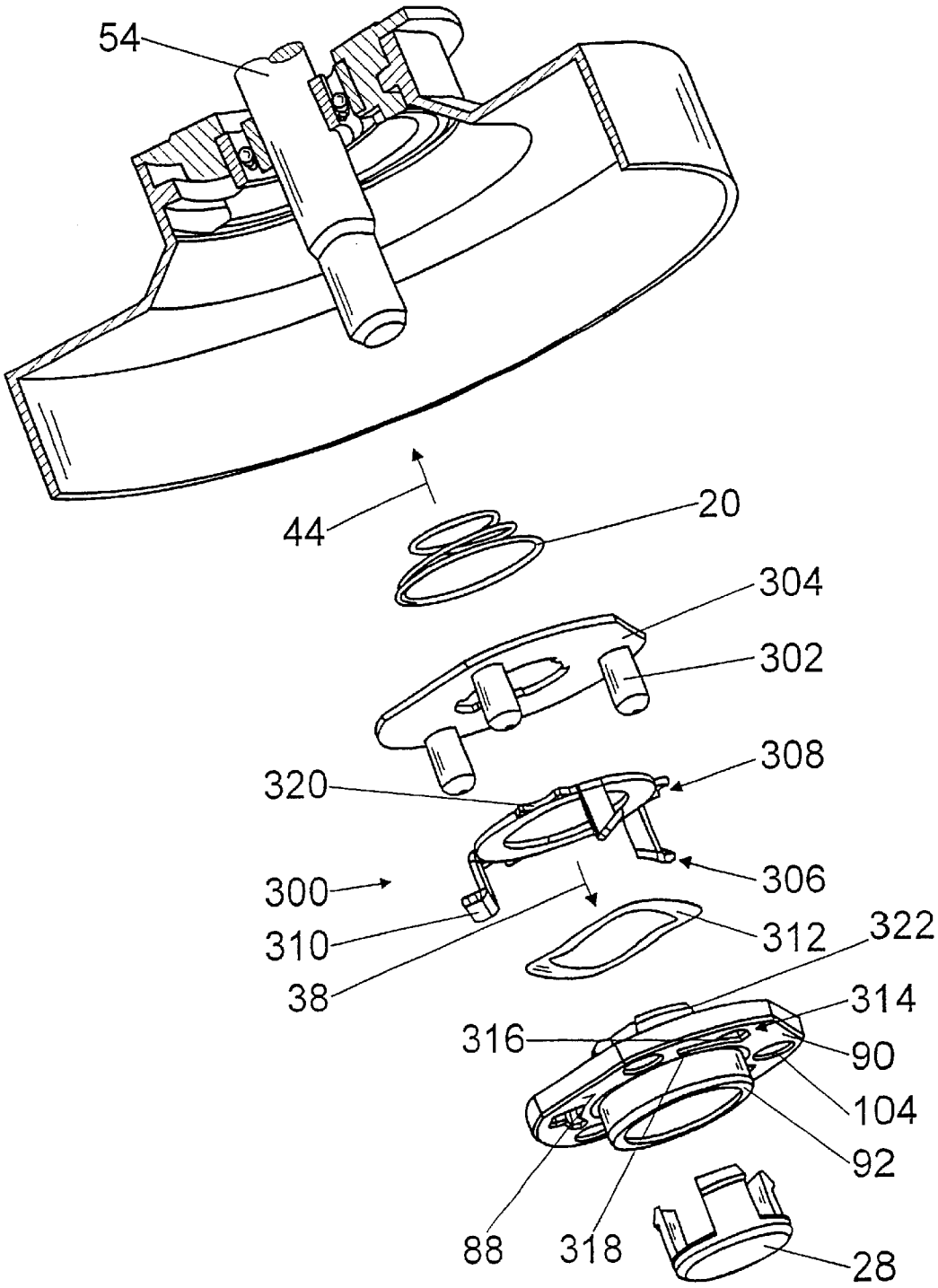
FIG. 13, an exploded view of a variant of FIG. 2.

In FIG. 13, an alternative exemplary embodiment to the exemplary embodiment of FIG. 4 is shown, with a slaving device 300. The slaving device 300 has a slaving flange 90, which forms a bearing face 88 for a cutting disk, not identified by reference numeral here. On the side toward the cutting disk, a collar 92 is formed onto the slaving flange 90, and by way of this collar the cutting disk with its centering bore is radially centered in the installed state. Radial forces can advantageously be absorbed by the slaving flange 90, without putting a load on an unlocking button 28.

On a side of the slaving flange 90 remote from the cutting disk, a sheet-metal plate 308 for axial fixation of the cutting disk is disposed, having three circumferentially uniformly distributed, integrally formed-on fastening elements 306 that extend in the axial direction 38. The fastening elements 306 are formed onto the sheet-metal plate 308 in a bending operation.

Figure 15:
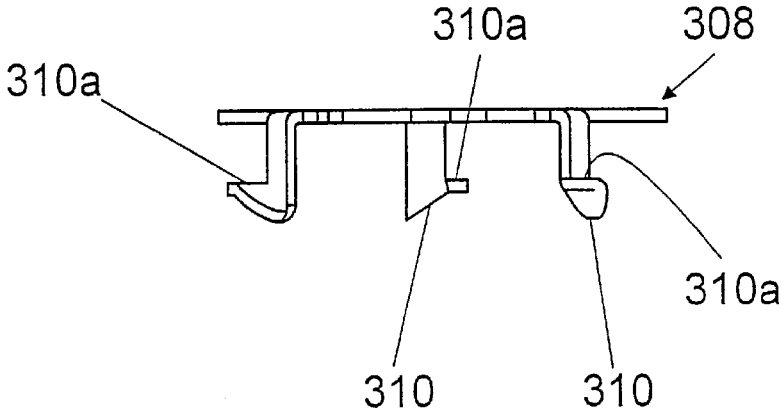
FIG. 15, a side view of a sheet-metal plate of FIG. 13.
Figure 16:
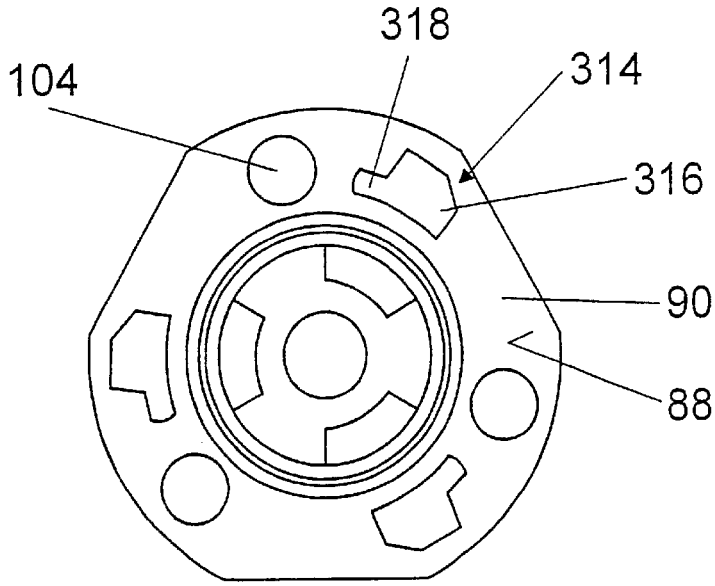
FIG. 16, a slaving flange from FIG. 13, seen from below.

Upon installation, the slaving flange 90, a wave washer 312 and the sheet-metal plate 308 are pre-installed. In the process, the wave washer 312 is slipped onto a collar 322, pointing in the direction away from the cutting disk, of the slaving flange 90. Next, the fastening elements 306 of the sheet-metal plate 308, which on their free end have a hook-shaped extension with an oblique face 310 pointing in the circumferential direction (FIGS. 13 and 15), are guided in the axial direction 38 by recesses 314 of the slaving flange 90, specifically by widened regions 316 of the recesses 314 (FIGS. 13 and 15). By compression and rotation of the sheet-metal plate 308 and slaving flange 90 against one another, the wave washer 312 is pre-stressed, and the sheet-metal plate 308 and the slaving flange 90 are connected by positive engagement in the axial direction 38, 44, specifically in that the hook-shaped extensions are rotated into narrow regions 318 of the recesses 314 (FIGS. 13, 15 and 16). Next, loaded by the wave washer 312, the sheet-metal plate 308 is braced on the bearing face 88 of the slaving flange 90 via edges 310*a* of the hook-shaped extensions, which point axially in the direction away from the cuting disk.

Figure 14:
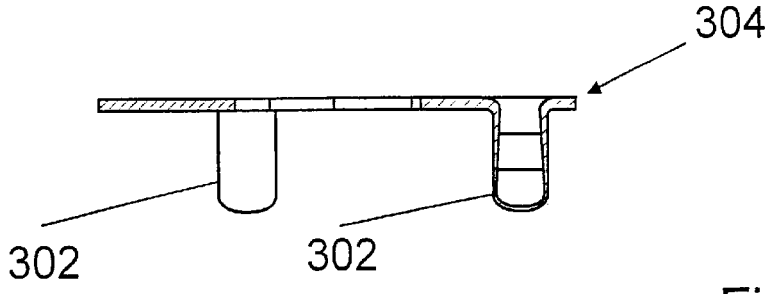
FIG. 14, a section through a slaving disk of FIG. 13 with a bolt formed onto it.

Once the sheet-metal plate 308 with the formed-on fastening elements 306, the wave washer 312 and the slaving flange 90 have been pre-installed, a compression spring 20 and a slaving disk 304, with three circumferentially uniformly distributed, integrally formed-on bolts 302 extending in the axial direction 38, are slipped onto a drive shaft 54. The bolts 302 are formed onto a sheet-metal plate forming the slaving disk 304 in a deep-drawing operation (FIG. 14).

Next, the pre-installed group of components, comprising the sheet-metal plate 308, wave washer 312 and slaving flange 90, are mounted on the drive shaft 54. In this operation, the bolts 302 are guided by recesses 320 formed onto the circumference of the sheet-metal plate 308 and by through bores 104 in the slaving flange 90, and in the installed state they reach through the through bores 104. The sheet-metal plate 308 and the slaving flange 90 are secured against rotating relative to one another via the bolts 302.

The slaving flange 90 is pressed onto the drive shaft 54 and then secured with a securing ring, not shown in detail. Instead of a press-fitted connection, however, other connections that appear useful to one skilled in the art are also conceivable, such as a threaded connection, and so forth.

Once in the installation of a cutting disk 18 (see FIGS. 3 and 4) the hook-shaped extensions of the fastening elements 306 are guided through the wide regions 58, 60, 62 of the elongated slots 64, 66, 68 of the sheet-metal hub 52 (FIG. 13), rotating the sheet-metal hub 52 counter to the driving direction 34 has the effect of displacing the hook-shaped extensions into the curved, narrow regions 70, 72, 74 of the elongated slots 64, 66, 68 of the sheet-metal hub 52. In the process, the sheet-metal plate 308 with the fastening elements 306 is displaced axially in the direction 38 via the oblique faces 310 counter to the pressure of the wave washer 312, until the edges 310*a* of the hook-shaped extensions come to rest in curved, narrow regions 70, 72, 74 laterally next to the elongated slots 64, 66, 68 of the sheet-metal hub 53. In the installed state, the wave washer 312, via the edges 310*a* of the hook-shaped extensions, presses the cutting disk 18 against the bearing face 88.

Alternatively, the fastening elements and elongated slots in the sheet-metal hub could be embodied as rotated by 180°, reversing the direction of installation, and the sheet-metal hubs would be rotated in the driving direction upon assembly. If the fastening elements are embodied as rotated by 180°, then in operation an oblique face of a lower face-end edge of the fastening element is in the lead, so that injuries from the face-end edge can be prevented.

| List of Reference Numerals | |
|---|---|
| 10 | Angle grinding machine |
| 12 | Slaving device |
| 14 | Slaving device |
| 16 | Slaving device |
| 18 | Insert tool |
| 20 | Spring element |
| 22 | Spring element |
| 24 | Detent element |
| 26 | Detent element |
| 28 | Unlocking button |
| 30 | Unlocking button |
| 32 | Insert tool |
| 34 | Circumferential direction |
| 36 | Circumferential direction |
| 38 | Direction |
| 40 | Fastening element |
| 42 | Fastening element |
| 44 | Direction |
| 46 | Recess |
| 48 | Recess |
| 50 | Recess |
| 52 | Tool hub |
| 54 | Drive shaft |
| 56 | Component |
| 58 | Region |
| 60 | Region |
| 62 | Region |
| 64 | Elongated slot |
| 66 | Elongated slot |
| 68 | Elongated slot |
| 70 | Region |
| 72 | Region |
| 74 | Region |
| 76 | Contact face |
| 78 | Contact face |
| 80 | Bearing face |
| 82 | Component |
| 84 | Recess |
| 86 | Spring element |

-continued

| List of Reference Numerals | |
|---|---|
| 88 | Bearing face |
| 90 | Component |
| 92 | Collar |
| 94 | Tool hub |
| 96 | Housing |
| 98 | Handle |
| 100 | Gearbox |
| 102 | Grip |
| 104 | Through bore |
| 106 | Segment |
| 108 | Recess |
| 110 | Snap ring |
| 112 | Recess |
| 114 | Grinding means |
| 116 | Centering bore |
| 118 | Slaving flange |
| 120 | Thread |
| 122 | Segment |
| 124 | Segment |
| 126 | Segment |
| 128 | Interstice |
| 130 | Interstice |
| 132 | Interstice |
| 134 | Groove |
| 136 | Groove |
| 138 | Groove |
| 140 | Rotation stop |
| 142 | Rotation stop |
| 144 | Rotation stop |
| 146 | Detent peg |
| 148 | Detent peg |
| 150 | Detent peg |
| 152 | Blocking segment |
| 154 | Blocking segment |
| 156 | Blocking segment |
| 158 | Recess |
| 160 | Recess |
| 162 | Recess |
| 164 | Bearing face |
| 166 | Bearing face |
| 168 | Bearing face |
| 170 | Protrusion |
| 172 | Spring elements |
| 174 | Spring elements |
| 176 | Spring elements |
| 178 | Recess |
| 180 | Bearing face |
| 300 | Slaving device |
| 302 | Detent element |
| 304 | Component |
| 306 | Element |
| 308 | Component |
| 310 | Oblique face |
| 310a | Edge |
| 312 | Spring element |
| 314 | Recess |
| 316 | Region |
| 318 | Region |
| 320 | Recess |
| 322 | Collar |

What is claimed is:

1. A grinding machine tool receptacle for a hand-guided angle grinding machine (10), having a slaving device (12, 14, 16, 300), by way of which an insert tool (18, 32) is operatively connectable to a drive shaft (54), characterized in that the insert tool (18, 32) is operatively connectable to the slaving device (14, 16, 300) via at least one detent element (24, 26, 302), supported movably counter to a spring element (20, 22), which detent element snaps into place in an operating position of the insert tool (18, 32) driven by the spring element (20, 22) and fixes the insert tool (18, 32) by positive engagement, wherein the detent element (24, 26, 302) is displaceable in the axial direction (44) counter to the spring element (20, 22), wherein the insert tool (18) is connected to the slaving device (12, 14, 300) in the circumferential direction (34, 38) via at least a first element (24, 302) and in the axial direction (38) via at least a second element (40, 42, 306), and wherein the second element (40, 42, 306) is arranged for fixing of the insert tool (18, 32) with a spring force.

2. The grinding machine tool receptacle of claim 1, characterized in that a drive moment can be transmitted via a positive-engagement connection between the insert tool (18, 32) and the slaving device (12, 14, 16, 300).

3. The grinding machine tool receptacle of claim 1, characterized in that the detent element (24, 26, 302) can be released from its detent position by an unlocking button (28, 30).

4. The grinding machine tool receptacle claim 1, characterized in that the insert tool (32) is connectable to the slaving device (16) via a tongue-and-groove connection, which is secured by positive engagement via at least one detent element (26) in an operating position of the insert tool (32).

5. The grinding machine tool receptacle of claim 1, characterized in that at least one detent element (302) is integrally formed onto a disklike component (304).

6. The grinding machine tool receptacle of claim 1 characterized in that at least two elements (306) for fixing the insert tool (18) in the axial direction (38) are integrally formed onto a diskilke component (308).

7. A grinding machine tool receptacle of claim 1, characterized in that the second element (40, 42, 306) is supported movably and loaded by a spring element.

8. A grinding machine tool receptacle as defined in claim 7, wherein the tool hub (52, 94) has a third recess provided for centering and formed separately from the first recess (46, 48, 50) and the second recess (64, 66, 68).

9. A grinding machine tool receptacle as defined in claim 1, wherein the second element (42, 306) is supported movably, is provided with a contact face (78*a*, 310*a*) and with the contact face (78*a*, 310*a*) of the second element (42, 306) the insert tool (18) is loadable in an axial direction (44) from a free end of the drive shaft (54) to a machine-side end bearing face (88) with a spring force of a spring element (86, 312).

10. A grinding machine tool receptacle as defined in claim 1, wherein said spring element (86, 312) is formed as a cup spring.

11. A grinding machine tool receptacle as defined in claim 1, wherein the insert tool (18, 32) in the operating position is connected with the slaving device (12, 14, 16, 300) through at least two second elements which are supported movably and loaded by a common cup spring element.

12. A grinding machine insert tool for an angle grinding machine (10), is connectable by a tool hub (52, 94), via a slaving device (12, 14, 16, 300) of a grinding machine tool receptacle, to a drive shaft (54) of a grinding machine (10), characterized in that the tool hub (52, 94) is operatively connectable to the slaving device (12, 14, 16, 300) via at least one detent element (24, 26, 302), supported movably counter to a spring element (20, 22), which detent element snaps into place in an operating position of the tool hub (52, 94) and fixes the tool hub (52, 94) by positive engagement, wherein at least a first recess (46, 48, 50) for a positive-engagement connection to the slaving device (12, 14, 300) in at least one circumferential direction (34, 36), and at least one second recess (64, 66, 68), separated from the first recess (46, 48, 50), for a positive-engagement connection in the axial direction (38) are made in the tool hub (52).

13. The grinding machine insert tool of claim 12, characterized in that at least elongated slot (64, 66, 68) is made in the tool hub (52), which elongated slot has one wide region (58, 60, 62) and at least one narrow region (70, 72, 74).

14. A grinding machine tool receptacle for a hand-guided angle grinding machine (10), having a slaving device (12, 14, 16, 300), by way of which an insert tool (18, 32) is operatively connectable to a drive shaft (54), characterized in that the insert tool (18, 32) is operatively connectable to the slaving device (14, 16, 300) via at least one detent element (24, 26, 302), supported movably counter to a spring element (20, 22), which detent element snaps into place in an operating position of the insert tool (18, 32) and fixes the insert tool (18, 32) by positive engagement, wherein the insert tool (18) is connected to the slaving (12, 14, 300) in the circumferential direction (34, 36) via at least a first element (24, 302) and in the axial direction (38) via at least a second element (40, 42, 306), and wherein at least one detent element (24, 302), extending in the axial direction (38), snaps into a recess (46, 48, 50), corresponding to the detent element (24, 302), of a tool hub (52) of the insert tool (18) in an operating position of the insert tool (18) and fixes the insert tool (18) in the circumferential direction (34, 36) by positive engagement.

15. A grinding machine tool receptacle fore hand-guided angle grinding machine (10), having a slaving device (12, 14, 16, 300), by way of which an insert tool (18, 32) is operatively connectable to a drive shaft (54), characterized in that the insert tool (18, 32) is operatively connectable to the slaving device (14, 16, 300) via at least one detent element (24, 26, 302), supported movably counter to a spring element (20, 22), which detent element snaps into place in an operating position of the insert tool (18, 32) and fixes the insert tool (18, 32) by positive engagement, wherein the insert tool (18) is connected to the slaving device (12, 14, 300) in the circumferential direction (34, 36) via at least a first element (24, 302) and in the axial direction (38) via at least a second element (40, 42, 306), and wherein at least one detent element (24) extending in the axial direction (38) is secured in a component (56) supported displaceably on the drive shaft (54) counter to the spring element (20).

16. A grinding machine tool receptacle for a hand-guided angle grinding machine (10), having a slaving device (12, 14, 16, 300), by way of which an insert tool (18, 32) is operatively connectable to a drive shaft (54), characterized in that the insert tool (18, 32) is operatively connectable to the slaving device (14, 16, 300) via at least one detent element (24, 26, 302), supported movably counter to a spring element (20, 22), which detent element snaps into place in an operating position of the insert tool (18, 32) and fixes the insert tool (18, 32) by positive engagement, wherein the insert tool (18) is connected to the slaving device (12, 14, 300) in the circumferential direction (34, 36) via at least a first element (24, 302) and in the axial direction (38) via at least a second element (40, 42, 306), and wherein the slaving device (12, 14, 300) has at least one fastening element (40, 42, 306), extending in the axial direction (38), which can be passed through at least one region (58, 60, 62) of an elongated slot (64, 66, 68) of a tool hub (52) of the insert tool (18) and in the elongated slot (64, 66, 68) is displaceable in a narrowed region (70, 72, 74) of the elongated slot (64, 66, 68), and by way of which the insert tool (18) is axially fixable in the elongated slot (64, 66, 68) via a contact face (76, 78, 310*a*) disposed on the fastening element (40, 42, 306).

17. The grinding machine tool receptacle of claim 16, characterized in that a component (82) forming a bearing face (80) for the insert tool (18), in the fastened state of the insert tool (18), has a recess (84) in the region of the elongated slot (64, 66, 68), into which recess part of the tool hub (52) is pressed elastically, in an operating position of the insert tool (18).

18. The grinding machine tool receptacle of claim 16, characterized in that the fastening element (42, 306) extending in the axial direction (38) is supported elastically displaceably in the axial direction (38) counter to a spring element (86, 312), for axially the insert tool (18).

19. A grinding machine tool receptacle for a hand-guided angle grinding machine (10), having a slaving device (12, 14, 16, 300), by way of which an insert tool (18, 32) is operatively connectable to a drive shaft (54), characterized in that the insert tool (18, 32) is operatively connectable to the slaving device (14, 16, 300) via at least one detent element (24, 26, 302), supported movably counter to a spring element (20, 22), which detent element snaps into place in an operating position of the insert tool (18, 32) and fixes the insert tool (18, 32) by positive engagement, wherein the insert tool (18) is connected to the slaving device (12, 14, 300) in the circumferential direction (34, 36) via at least a first element (24, 302) and in the axial direction (38) via at least a second element (40, 42, 306), wherein a collar (92), by way of which the insert tool (18) can be radially centered, is formed onto a component (90) of the slaving device (14, 300) that forms a bearing face (88) for the insert tool (18).

* * * * *